US011035362B2

(12) United States Patent
Nair et al.

(10) Patent No.: US 11,035,362 B2
(45) Date of Patent: Jun. 15, 2021

(54) OIL PUMP FOR AN AGED ENGINE

(71) Applicant: PROGRESS RAIL LOCOMOTIVE INC., Lagrange, IL (US)

(72) Inventors: Adarsh Gopinathan Nair, Darien, IL (US); Mathias Klemp, Mexico, IN (US); Kyle Figge, Indianapolis, IN (US); Vijaya Kumar, Naperville, IL (US); Patricia McWade, Willowbrook, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 0 days.

(21) Appl. No.: 16/544,750

(22) Filed: Aug. 19, 2019

(65) Prior Publication Data

US 2021/0054840 A1 Feb. 25, 2021

(51) Int. Cl.

| | |
|---|---|
| ***F04C 11/00*** | (2006.01) |
| ***F01M 1/16*** | (2006.01) |
| ***F04B 41/06*** | (2006.01) |
| ***F01P 3/02*** | (2006.01) |
| *F01M 1/02* | (2006.01) |

(52) U.S. Cl.

CPC ..... *F04C 11/001* (2013.01); *F01M 1/16* (2013.01); *F01P 3/02* (2013.01); *F04B 41/06* (2013.01); *F01M 2001/0207* (2013.01)

(58) Field of Classification Search

CPC . F04C 11/001; F01M 1/16; F01M 2001/0207; F01P 3/02; F04B 49/00; F04B 41/06

See application file for complete search history.

(56) References Cited

U.S. PATENT DOCUMENTS

| | | | | |
|---|---|---|---|---|
| 6,318,333 | B1 * | 11/2001 | Narita | F01M 1/02 123/196 R |
| 6,679,692 | B1 | 1/2004 | Feuling | |
| 7,290,991 | B2 | 11/2007 | Staley et al. | |
| 7,942,645 | B2 | 5/2011 | Kim et al. | |
| 8,827,660 | B2 | 9/2014 | Frokjaer et al. | |
| 2005/0180870 | A1 | 8/2005 | Stanley et al. | |
| 2007/0240919 | A1 | 10/2007 | Carlson | |
| 2013/0223999 | A1 * | 8/2013 | Paulson | F04C 11/001 415/182.1 |
| 2020/0208629 | A1 * | 7/2020 | Valkenberg | F04C 2/123 |

FOREIGN PATENT DOCUMENTS

| | | | |
|---|---|---|---|
| DE | 19926350 | C1 | 11/2000 |
| DE | 10322304 | A1 | 12/2004 |
| DE | 102016104416 | A1 | 9/2017 |
| FR | 2909410 | A1 | 6/2008 |
| JP | 2005163570 | | 6/2005 |
| JP | 2012215118 | | 11/2012 |

* cited by examiner

*Primary Examiner* — Jacob M Amick

(74) *Attorney, Agent, or Firm* — von Briesen & Roper, s.c.

(57) ABSTRACT

An oil pump for an engine is disclosed. The oil pump may include a first pump mechanism configured to supply oil to a main lubrication gallery of the engine, and a second pump mechanism configured to supply oil to a piston cooling gallery of the engine. The first pump mechanism may be designed for a first type of engine and the second pump mechanism may be designed for a second type of engine. The first type of engine may have a greater quantity of cylinders than the second type of engine.

20 Claims, 4 Drawing Sheets

OIL PUMP FOR AN AGED ENGINE

TECHNICAL FIELD

The present disclosure relates generally to oil pumps and, for example, to an oil pump for an aged engine.

BACKGROUND

Internal combustion engines require lubricating systems to lubricate moving parts and to remove heat. In some internal combustion engines, a lubricating system may include an oil pump that distributes oil throughout the engine via one or more oil galleries, and a scavenge pump that collects spent oil and returns the spent oil to the oil pump for further distribution. Engines, and in particular engines used for heavy machinery, may experience low oil pressure later in service life. This low oil pressure is the result of the lubrication system lacking the capacity to meet increased oil flow demands created by engine wear over the life of the engine. Such low oil pressure conditions may negatively impact engine wear, engine cooling capacity, and overall engine performance.

While a larger capacity oil pump may be considered as a solution for increasing oil pressure in aged engines, this approach is often difficult in a retrofit application. In particular, increasing the capacity of the oil pump may cause the oil pump's capacity to reach or exceed the scavenge pump's capacity. When this occurs, the scavenge pump cannot return spent oil to the lubrication system at a rate that is sufficient to meet demands of the oil pump, thereby introducing air into the oil. In such cases, the air may reduce an efficacy of the oil, and result in increased engine wear and engine damage.

One attempt at a dual oil supply pump is disclosed in U.S. Pat. No. 7,290,991 that issued to Staley et al. on Nov. 6, 2007 ("the '991 patent"). In particular, the '991 patent discloses an oil pump assembly having first and second pump mechanisms contained within a common housing. The pump mechanisms may have different displacements or flow rates if desired. As described in the '991 patent, the first and second pump mechanisms draw in oil through an inlet of the housing and discharge the oil toward respective outlets. The '991 patent indicates that as the oil pump outlet pressure increases at the outlets during engine operation, pressure relief valves open at respective pressure control settings. The valves direct excess oil flow to a common reservoir. The '991 patent states that this maintains prescribed oil pressures at the outlets and in connecting galleries of the engine, and limits the likelihood of pump cavitation.

While the dual supply oil pump of the '991 patent attempts to maintain prescribed oil pressures at outlets of the oil pump, the '991 patent does not address compensating for system pressure losses that result from engine wear over time. Particularly, the '991 patent does not address compensating for system pressure losses while maintaining a capacity of the oil pump at less than a capacity of a scavenge pump. As described above, air entrainment in the oil may result when the capacity of the oil pump is near the capacity of the scavenge pump, thereby worsening engine performance, wear, damage, and/or the like.

The oil pump of the present disclosure solves one or more of the problems set forth above and/or other problems in the art.

SUMMARY

According to some implementations, an oil pump for an engine may include a first pump mechanism configured to supply oil to a main lubrication gallery of the engine; and a second pump mechanism configured to supply oil to a piston cooling gallery of the engine, the first pump mechanism being designed for a first type of engine and the second pump mechanism being designed for a second type of engine, and the first type of engine having a greater quantity of cylinders than the second type of engine.

According to some implementations, an engine may include a main engine component that is supplied oil by a main lubrication gallery; a piston-cylinder component that is supplied oil by a piston cooling gallery; and an oil pump having: a first pump mechanism configured to supply oil to the main lubrication gallery, and a second pump mechanism configured to supply oil to the piston cooling gallery, the first pump mechanism being designed for another type of engine and the second pump mechanism being designed for the engine, and the other type of engine having a greater quantity of cylinders than the engine.

According to some implementations, a lubrication system for an engine may include a main lubrication gallery configured to supply oil to a main engine component of the engine; a piston cooling gallery configured to supply oil to a piston-cylinder component of the engine; an oil pump having: a first pump mechanism configured to supply oil to the main lubrication gallery, and a second pump mechanism configured to supply oil to the piston cooling gallery, the first pump mechanism being designed for a first type of engine and the second pump mechanism being designed for a second type of engine, and the first type of engine having a greater quantity of cylinders than the second type of engine; and a scavenge pump configured to return spent oil to the oil pump, the scavenge pump being designed for the second type of engine.

DETAILED DESCRIPTION

This disclosure relates to an oil pump. The oil pump has universal applicability to any machine utilizing an internal combustion engine. The term "machine" may refer to any machine that performs an operation associated with an industry such as, for example, mining, construction, farming, transportation, or any other industry. As some examples, the machine may be a vehicle, a locomotive, a backhoe loader, a cold planer, a wheel loader, a compactor, a generator, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, or marine equipment. Moreover, one or more implements may be connected to the machine and driven from the internal combustion engine.

Figure 1:
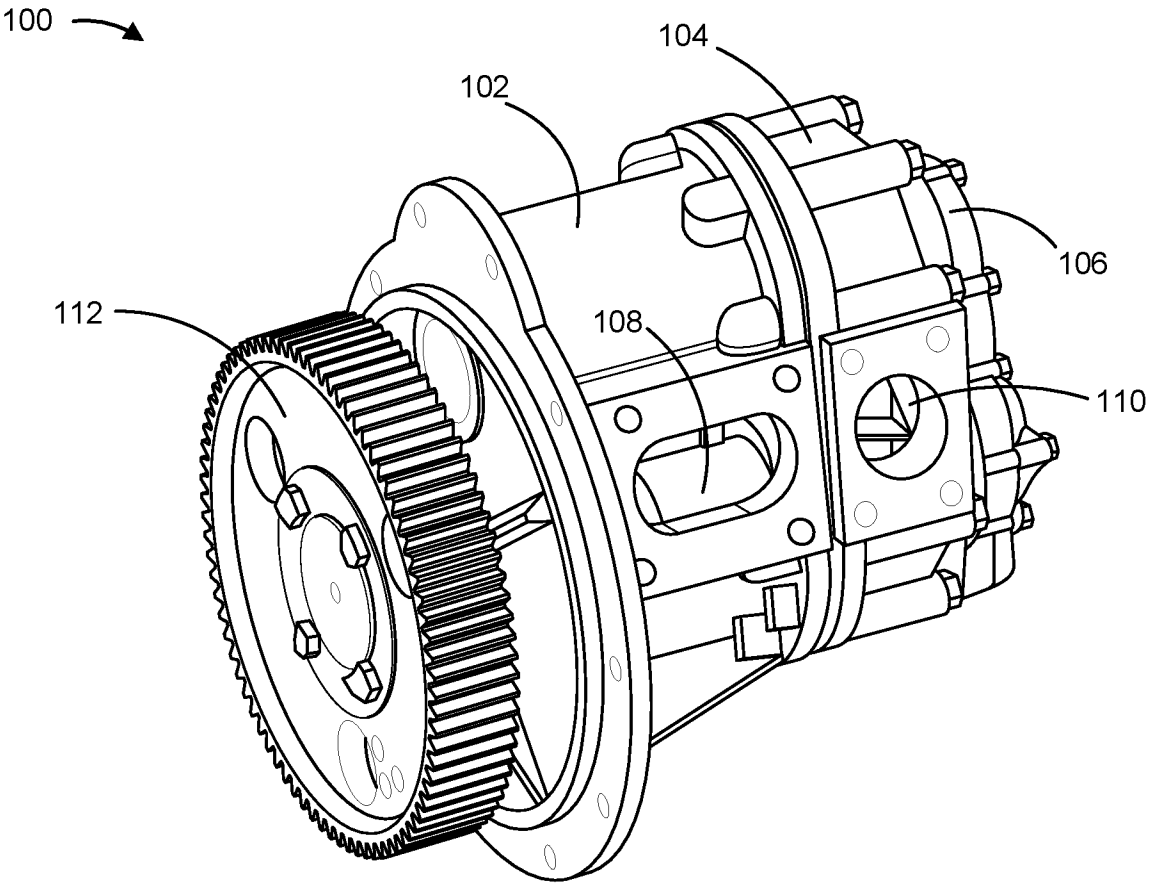
FIG. 1 is a diagram of an example oil pump.

FIG. 1 is a diagram of an example oil pump 100. The oil pump 100 may distribute oil to an engine associated with the oil pump 100. As used herein, "oil" may refer to any natural or synthetic oil, or other lubricant, used to lubricate an engine. The oil pump 100 may include dual pump mechanisms that pressurize and supply oil to respective areas of the engine. Furthermore, the dual pump mechanisms may supply oil at different flow rates. For example, the dual pump mechanisms may include a high-capacity pump mechanism and a low-capacity pump mechanism.

As shown in FIG. 1, the oil pump 100 may include a first housing 102 (e.g., a metal casting) and a second housing 104 (e.g., a metal casting) that define a housing of the oil pump together with an end plate 106. The first housing 102 and the second housing 104 each may define an internal chamber that houses a pump mechanism (e.g., one of the dual pump mechanisms).

The first housing 102 may include a first inlet 108, and the second housing 104 may include a second inlet 110. The first inlet 108 and the second inlet 110 may be supplied oil by a common hose (not shown), such as a manifold, having a first branch that supplies the first inlet 108 and a second branch that supplies the second inlet 110. The first housing 102 may include a first outlet (not shown) opposite the first inlet 108, and the second housing 104 may include a second outlet (not shown) opposite the second inlet 110. Oil (e.g., pressurized oil) may exit the first housing 102 via the first outlet, and oil may exit the second housing 104 via the second outlet. The first outlet and the second outlet may be similarly sized, shaped, and located on the first housing 102 and second housing 104, respectively, as shown in FIG. 1 for the first inlet 108 and the second inlet 110, respectively.

The oil pump 100 may include an input drive gear 112 that powers the dual pump mechanisms. A power source (not shown), such as the engine, may provide a power input to the input drive gear 112.

As indicated above, FIG. 1 is provided as an example. Other examples may differ from what is described with regard to FIG. 1.

Figure 2:
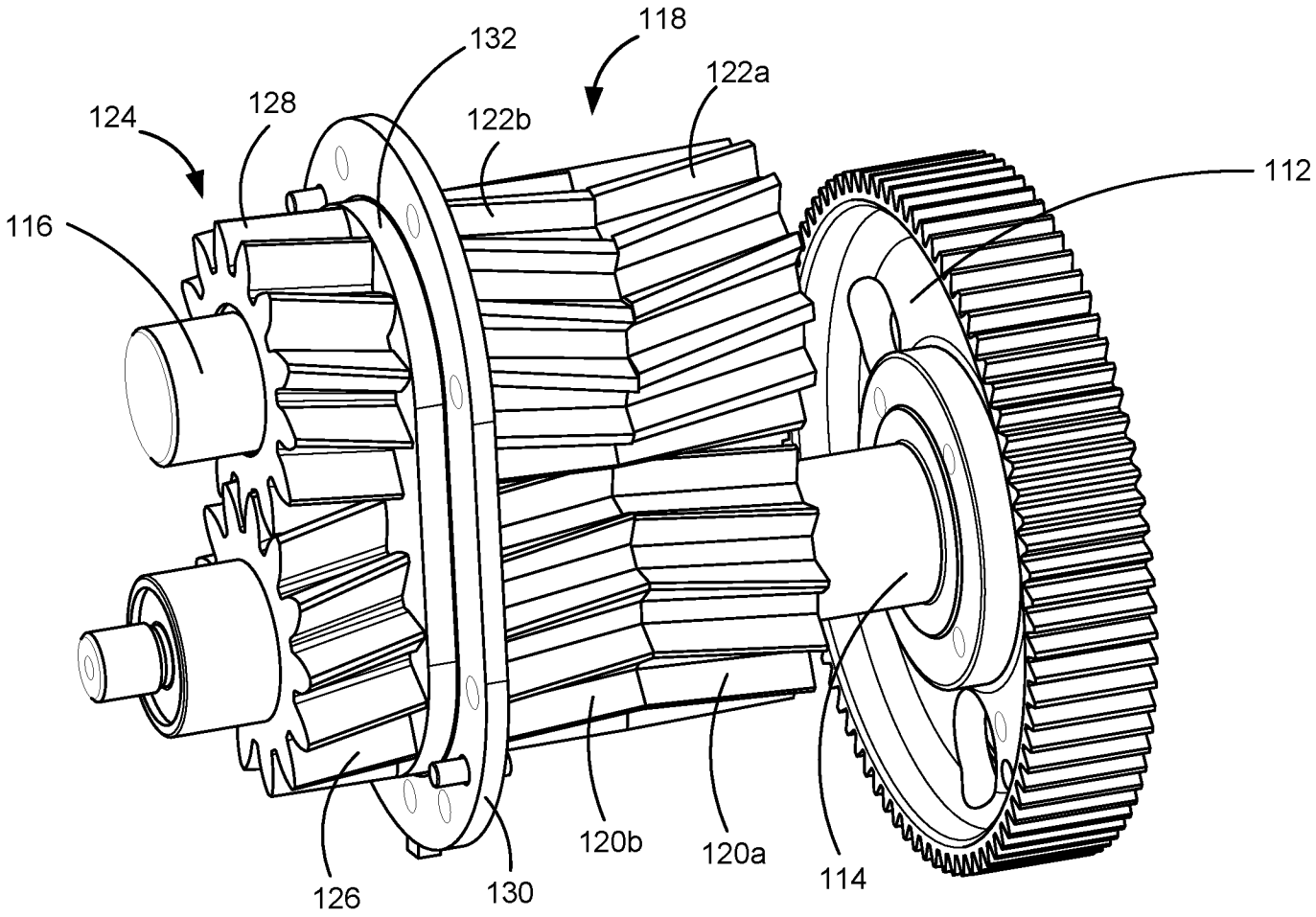
FIG. 2 is a diagram of example dual pump mechanisms included in the oil pump of FIG. 1.

FIG. 2 is a diagram of example dual pump mechanisms of the oil pump 100. As shown in FIG. 2, the dual pump mechanisms may receive power via a drive shaft 114, which is driven by the input drive gear 112. The dual pump mechanisms may also include a static shaft 116, parallel to the drive shaft 114, that is attached to the housing of the oil pump 100. The static shaft 116 may be attached by a bolt that is safety wired to prevent the bolt from dislodging.

The dual pump mechanisms may include a first pump mechanism 118. The first pump mechanism 118 may be a high-capacity pump mechanism. In such a case, the first pump mechanism 118 may supply oil to a main lubrication gallery, which supplies oil to a main component of the engine (shown in FIG. 4). The first pump mechanism 118 may include a set of gears (e.g., a gear pump). For example, the first pump mechanism 118 may include a set of two gears (e.g., as a pair) or a set of four gears (e.g., as two pairs). A gear of the set of gears may include helical gear teeth. In some implementations, a gear of the set of gears may be composed of steel, such as hardened steel. The first pump mechanism 118 may include a first drive gear 120 disposed on the drive shaft 114, and a first driven gear 122 disposed (e.g., free floating) on the static shaft 116 and driven by the first drive gear 120. The first drive gear 120 may include a single gear, or may include two attached gears 120*a* and 120*b*. Gears 120*a* and 120*b* may be symmetrical about a plane that separates gears 120*a* and 120*b*. The first driven gear 122 may include a single gear, or may include two gears (e.g., two attached gears) 122*a* and 122*b*. Gears 122*a* and 122*b* may be symmetrical about a plane that separates gears 122*a* and 122*b*.

The dual pump mechanisms may include a second pump mechanism 124. The second pump mechanism 124 may be a low-capacity pump mechanism (i.e., relative to the first pump mechanism 118). In such a case, the second pump mechanism 124 may supply oil to a piston cooling gallery, which supplies oil to a piston-cylinder component of the engine (e.g., engine 142, shown in FIG. 4). The second pump mechanism 124 may include a set of gears (e.g., a gear pump). For example, the second pump mechanism 124 may include a set of two gears (e.g., as a pair). A gear of the set of gears may include helical gear teeth. In some implementations, a gear of the set of gears may be composed of steel, such as hardened steel. The second pump mechanism 124 may include a second drive gear 126 disposed on the drive shaft 114, and a second driven gear 128 disposed (e.g., free floating) on the static shaft 116 and driven by the second drive gear 126.

The first pump mechanism 118 may be designed for a first type of engine, and the second pump mechanism 124 may be designed for a second type of engine. For example, the first pump mechanism 118 may have a capacity that is designed for (e.g., suitable for) a first type of engine (e.g., prior to use of the first type of engine), and the second pump mechanism may have a capacity that is designed for (e.g., suitable for) a second type of engine (e.g., prior to use of the second type of engine). In other words, the first pump mechanism 118 may have a capacity that is designed to meet oil pressure requirements (e.g., oil pressure requirements for a main engine component) specified for the first type of engine, and the second pump mechanism 124 may have a capacity that is designed to meet oil pressure requirements (e.g., oil pressure requirements for a piston-cylinder component) specified for the second type of engine.

The first type of engine may have a greater quantity of cylinders than the second type of engine, such that the first type of engine has a greater maximum power output than the second type of engine. In such a case, the first type of engine may have greater than 2, 3, 4, 5, 6, 8, 10, 12, 14, 16, 18, 20, or 24 cylinders, and the second type of engine may have 2, 3, 4, 5, 6, 8, 10, 12, 14, 16, 18, 20, or 24 cylinders or fewer, respectively. As an example, the first type of engine may have greater than 16 cylinders, and the second type of engine may have 16 cylinders or fewer. For example, the first type of engine may have 20 cylinders, and the second type of engine may have 16 cylinders.

Accordingly, the first drive gear 120 and the first driven gear 122 may have a greater gear width (e.g., in an axial direction along the drive shaft 114 or the static shaft 116) than the second drive gear 126 and the second driven gear 128. For example, a ratio of a gear width of the first drive gear 120 to the second drive gear 126 may be in a range from approximately 2.75:1 to 3.25:1. As an example, the ratio may be approximately 3:1.

Moreover, the first pump mechanism 118 may have a greater flow rate (e.g., displacement) than the second pump mechanism 124. For example, a flow rate of the first pump mechanism 118 may be in a range from approximately 260 to 300 gallons per minute (GPM), and a flow rate of the second pump mechanism 124 may be in a range from approximately 80 to 120 GPM. As another example, a ratio of a flow rate of the first pump mechanism 118 to a flow rate of the second pump mechanism 124 may be in a range from approximately 2.5:1 to 4:1. As an example, the ratio may be in a range from approximately 2.5:1 to 3:1. A range described herein may include the endpoints specified for the range.

As shown in FIG. 2, the first pump mechanism 118 and the second pump mechanism 124 may be separated by a separation plate 130. The separation plate 130 may be an end wall of the first housing 102 and/or the second housing 104 (shown in FIG. 1). Alternatively, the separation plate 130 may be disposed between the first housing 102 and/or the second housing 104 (e.g., when the first housing 102 and the second housing 104 do not have end walls). The separation plate 130 may isolate (e.g., substantially isolate) the first housing 102 and the second housing 104 such that the first pump mechanism 118 may produce a flow rate that is different from a flow rate produced by the second pump mechanism 124.

In some implementations, the second pump mechanism 124 may be associated with a spacer plate 132. The spacer plate 132 may abut the separation plate 130. The spacer plate 132 may have a particular width that permits reduction in the gear width of the second drive gear 126 and the second driven gear 128 so as to produce a desired flow rate.

As indicated above, FIG. 2 is provided as an example. Other examples may differ from what is described with regard to FIG. 2.

Figure 3:
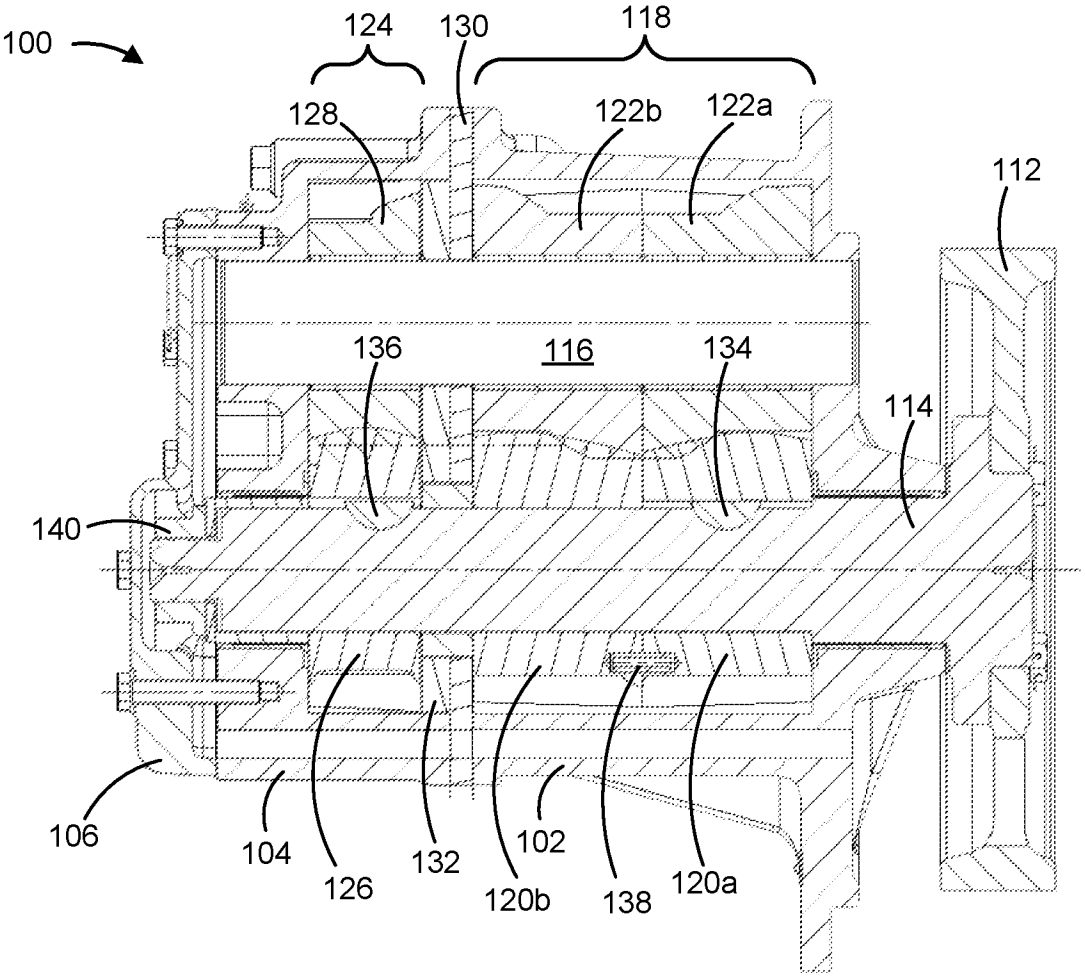
FIG. 3 is a diagram of a cross sectional view of the oil pump of FIG. 1.

FIG. 3 is a diagram of a cross sectional view of the oil pump 100. As shown in FIG. 3, the first drive gear 120 may be attached to the drive shaft 114 by a first key 134, and the second drive gear 126 may be attached to the drive shaft 114 by a second key 136. The first key 134 and the second key 136 may be Woodruff keys. As shown in FIG. 3, a first gear 120*a* of the first drive gear 120 may be attached to the drive shaft 114 by the first key 134, and a second gear 120*b* of the first drive gear 120 may be attached to the first gear 120*a*. The second gear 120*b* may be attached to the first gear 120*a* by a pin 138. In addition, the drive shaft 114 may be disposed (e.g., free floating) relative to the second housing 104 using a nut 140. The nut 140 may be torqued to a particular value.

As indicated above, FIG. 3 is provided as an example. Other examples may differ from what is described with regard to FIG. 3.

Figure 4:
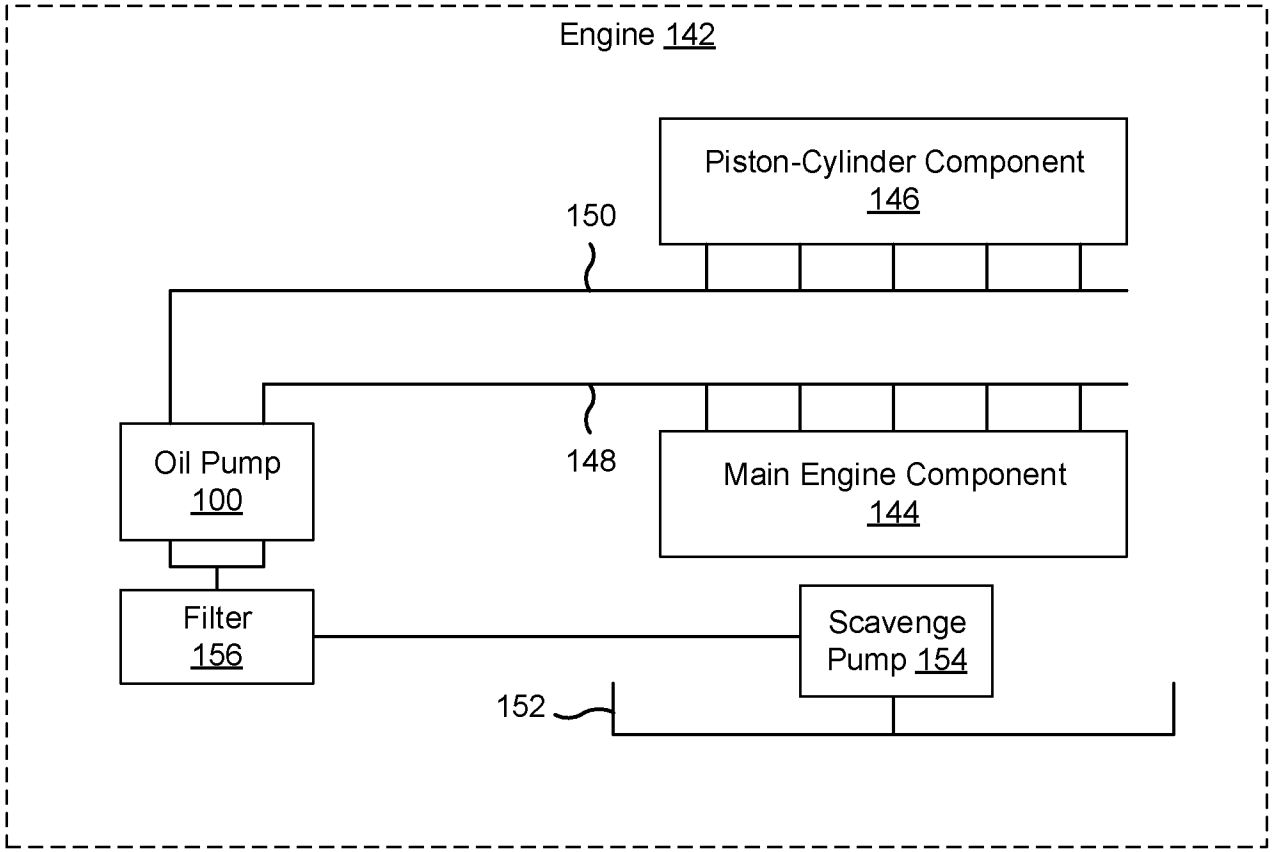
FIG. 4 is a diagram of an example engine with a lubrication system that employs the oil pump of FIG. 1.

FIG. 4 is a diagram of an example engine 142 with an example lubrication system. As shown in FIG. 4, the engine 142 may include a main engine component 144 and a piston-cylinder component 146. The main engine component 144 may be associated with a crankshaft and main bearings (not shown) of the engine 142. The piston-cylinder component 146 may be associated with a plurality of pistons (not shown), each contained by a cylinder. The plurality of pistons may be connected with the crankshaft.

The engine 142 may be the second type of engine described herein. For example, the engine 142 may have a quantity of cylinders that is less than an engine for which the first pump mechanism 118 is designed. The engine 142 may be an aged engine (e.g., an engine that has experienced wear to parts of the engine, thereby resulting in an oil pressure that is below a threshold value associated with an oil pressure requirement for the engine). For example, the engine 142 may be a rebuilt engine, may have an age, since a first use, that is greater than a threshold age (e.g., 5 years, 10 years, 15 years, and/or the like), may have an associated mileage that is greater than a threshold mileage (e.g., 100,000 miles, 200,000 miles, and/or the like), and/or the like. Parts of the engine 142 (e.g., parts of the main engine component 144) may have greater clearances (e.g., due to wear) than the parts had prior to use of the engine 142. For example, parts of the crankshaft (e.g., the crankshaft and the main bearings) may have greater clearances than the parts of the crankshaft had prior to use of the engine 142.

As further shown in FIG. 4, the lubrication system may include the oil pump 100, a main lubrication gallery 148, a piston cooling gallery 150, a sump 152, a scavenge pump 154, and a filter 156. The main lubrication gallery 148 may include one or more hoses, conduits, and/or the like that are part of a first circuit of the lubrication system. The piston cooling gallery 150 may include one or more hoses, conduits, and/or the like that are part of a second circuit of the lubrication system. The first pump mechanism 118 may supply oil to the main lubrication gallery 148, and the main lubrication gallery 148 may distribute the oil to the main engine component 144 (e.g., via one or more passageways in the main engine component 144). The second pump mechanism 124 may supply oil to the piston cooling gallery 150, and the piston cooling gallery 150 may distribute the oil to the piston-cylinder component 146 (e.g., via one or more spray nozzles directed at the piston-cylinder component 146).

Spent oil that was supplied to the main engine component 144 and/or the piston-cylinder component 146 may collect in the sump 152. The scavenge pump 154 may return the spent oil from the sump 152 to the oil pump 100. For example, the scavenge pump 154 may return the spent oil from the sump 152 to the oil pump 100 via the filter 156. The filter 156 may be configured to remove particles from the spent oil before the oil is returned to the oil pump 100. In addition, the filter 156 may be associated with an oil cooler and/or a strainer that process the spent oil before the oil is returned to the oil pump 100.

The scavenge pump 154 may be designed for the second type of engine described herein. The scavenge pump 154 may have a greater flow rate than a combined flow rate of the first pump mechanism 118 and the second pump mechanism 124. In particular, the scavenge pump 154 may have a flow rate that is at least 5% greater, at least 7% greater, at least 10% greater, and/or the like, than a combined flow rate of the first pump mechanism 118 and the second pump mechanism 124. For example, the scavenge pump 154 may have a flow rate that is in a range from approximately 425 to 475 GPM. As an example, the scavenge pump 154 may have a flow rate that is approximately 450 GPM.

As indicated above, FIG. 4 is provided as an example. Other examples may differ from what is described with regard to FIG. 4.

INDUSTRIAL APPLICABILITY

The disclosed oil pump 100 may be used with any engine where improved oil pressure is desired, such as an engine that has experienced wear to parts due to use of the engine. In this way, the oil pump 100 may provide oil pressure to an aged engine that is within an optimal range for the engine, thereby reducing engine wear and extending a useful life of the engine. Moreover, the disclosed oil pump 100 provides a retrofit for aged engines that maintains a capacity of the oil pump 100 at less than a capacity of the scavenge pump 154. In this way, the oil pump 100 may be retrofitted to an aged engine without replacement of the scavenge pump 154, thereby improving a useful life of the engine and the scavenge pump 154. For example, the oil pump 100 may be retrofitted to an aged 16-cylinder engine having a scavenge pump 154 that is designed for use with the 16-cylinder engine while maintaining the relative capacities of the oil pump 100 and the scavenge pump 154 within an optimal range, and without requiring replacement of the scavenge pump 154 in order to achieve the optimal range.

As used herein, the articles "a" and "an" are intended to include one or more items, and may be used interchangeably with "one or more." Also, as used herein, the terms "has,"

"have," "having," or the like are intended to be open-ended terms. Further, the phrase "based on" is intended to mean "based, at least in part, on."

The foregoing disclosure provides illustration and description, but is not intended to be exhaustive or to limit the implementations to the precise form disclosed. Modifications and variations may be made in light of the above disclosure or may be acquired from practice of the implementations. It is intended that the specification be considered as an example only, with a true scope of the disclosure being indicated by the following claims and their equivalents. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

What is claimed is:

1. An oil pump for an engine, comprising:

a first pump mechanism, located in a first housing, configured to supply oil to a main lubrication gallery of the engine;

a second pump mechanism, located in a second housing, configured to supply oil to a piston cooling gallery of the engine;

a separation plate disposed between the first housing and the second housing; and a spacer plate associated with the second pump mechanism abutting the separation plate, the first pump mechanism being designed for a first type of engine and the second pump mechanism being designed for a second type of engine, the first type of engine having a greater quantity of cylinders than the second type of engine.

2. The oil pump of claim 1, wherein the first type of engine has a greater maximum power output than the second type of engine.

3. The oil pump of claim 1, wherein the first type of engine has greater than 16 cylinders, and the second type of engine has 16 cylinders or fewer.

4. The oil pump of claim 1, wherein the first pump mechanism is a first set of gears comprising a first and second drive gear, and the second pump mechanism is a second set of gears comprising a third drive gear.

5. The oil pump of claim 4, wherein the first and second drive gear has a greater gear width than the third drive gear.

6. The oil pump of claim 4, wherein the first set of gears includes 4 gears, and the second set of gears includes 2 gears.

7. The oil pump of claim 1, wherein the first pump mechanism has a capacity designed for the first type of engine, and the second pump mechanism has a capacity designed for the second type of engine.

8. The oil pump of claim 1, wherein the first pump mechanism has a greater flow rate than the second pump mechanism.

9. The oil pump of claim 1, wherein a flow rate of the first pump mechanism is in a range from 260-300 gallons per minute (GPM) and a flow rate of the second pump mechanism is in a range from 80-120 GPM.

10. The oil pump of claim 1, wherein a ratio of a flow rate of the first pump mechanism to a flow rate of the second pump mechanism is in a range from 2.5:1 to 4:1.

11. An engine, comprising:

a main engine component that is supplied oil by a main lubrication gallery;

a piston-cylinder component that is supplied oil by a piston cooling gallery; and an oil pump having:

a first pump mechanism configured to supply oil to the main lubrication gallery, a second pump mechanism configured to supply oil to the piston cooling gallery, the first pump mechanism located in a first housing and the second pump mechanism located in a second housing, a separation plate disposed between the first housing and the second housing; and a spacer plate associated with the second pump mechanism abutting the separation plate, the first pump mechanism being designed for another type of engine and the second pump mechanism being designed for the engine, the other type of engine having a greater quantity of cylinders than the engine.

12. The engine of claim 11, wherein the first pump mechanism is a first set of gears, and the second pump mechanism is a second set of gears.

13. The engine of claim 12, wherein a ratio of a gear width of the first set of gears to a gear width of the second set of gears is in a range from 2.75:1 to 3.25:1.

14. The engine of claim 11, wherein parts of a crankshaft of the main engine component have greater clearances than the parts of the crankshaft had prior to use of the engine.

15. The engine of claim 11, wherein the engine has 16 cylinders or fewer, and the other type of engine has greater than 16 cylinders.

16. A lubrication system for an engine, comprising:

a main lubrication gallery configured to supply oil to a main engine component of the engine;

a piston cooling gallery configured to supply oil to a piston-cylinder component of the engine;

an oil pump having:

a first pump mechanism, located in a first housing, configured to supply oil to the main lubrication gallery, a second pump mechanism, located in a second housing, configured to supply oil to the piston cooling gallery, a separation plate disposed between the first housing and the second housing; and a spacer plate associated with the second pump mechanism abutting the separation plate, the first pump mechanism being designed for a first type of engine and the second pump mechanism being designed for a second type of engine, the first type of engine having a greater quantity of cylinders than the second type of engine; and a scavenge pump configured to return spent oil to the oil pump, the scavenge pump being designed for the second type of engine.

17. The lubrication system of claim 16, wherein the scavenge pump has a greater flow rate than a combination of the first pump mechanism and the second pump mechanism.

18. The lubrication system of claim 16, wherein the scavenge pump has a flow rate that is at least 5% greater than a combination of the first pump mechanism and the second pump mechanism.

19. The lubrication system of claim 16, wherein a ratio of a flow rate of the first pump mechanism to a flow rate of the second pump mechanism is in a range from 2.5:1 to 4:1.

20. The lubrication system of claim 16, wherein the first type of engine has greater than 16 cylinders, and the second type of engine has 16 cylinders or fewer.

* * * * *